US008132694B2

(12) United States Patent
Keller

(10) Patent No.: US 8,132,694 B2
(45) Date of Patent: Mar. 13, 2012

(54) DISPENSING DEVICE COMPRISING A DISPENSING APPLIANCE AND A MULTICOMPONENT SYRINGE

(75) Inventor: Wilhelm A. Keller, Merlischachen (CH)

(73) Assignee: Sulzer Mixpac AG, Haag (Rheintal) (CH)

( * ) Notice: Subject to any disclaimer, the term of this patent is extended or adjusted under 35 U.S.C. 154(b) by 782 days.

(21) Appl. No.: 11/658,020

(22) PCT Filed: Jul. 19, 2005

(86) PCT No.: PCT/CH2005/000422

§ 371 (c)(1),
(2), (4) Date: Jan. 22, 2007

(87) PCT Pub. No.: WO2006/015506

PCT Pub. Date: Feb. 16, 2006

(65) Prior Publication Data

US 2007/0289998 A1 Dec. 20, 2007

(30) Foreign Application Priority Data

Aug. 9, 2004 (CH) ..... 1321/04

(51) Int. Cl.
*B67D 7/70* (2010.01)

(52) U.S. Cl. ..... 222/137; 222/145.6; 222/326; 222/327; 604/191

(58) Field of Classification Search ..... 222/137, 222/145.5, 145.6, 326, 327, 391; 604/191
See application file for complete search history.

(56) References Cited

U.S. PATENT DOCUMENTS

| | | | | |
|---|---|---|---|---|
| 5,005,735 | A | 4/1991 | Keller | |
| 5,129,825 | A * | 7/1992 | Discko, Jr. | 222/325 |
| 5,336,014 | A | 8/1994 | Keller | |
| 5,441,175 | A | 8/1995 | Jacobsen et al. | |
| 5,542,934 | A * | 8/1996 | Silver | 604/191 |
| 5,722,829 | A * | 3/1998 | Wilcox et al. | 222/137 |
| 5,918,772 | A | 7/1999 | Keller et al. | |
| 5,924,600 | A * | 7/1999 | Keller | 222/137 |
| 5,992,694 | A | 11/1999 | Keller | |
| 6,186,363 | B1 | 2/2001 | Keller | |
| 6,398,761 | B1 * | 6/2002 | Bills et al. | 604/191 |
| 6,769,574 | B1 | 8/2004 | Keller et al. | |
| 6,820,766 | B2 | 11/2004 | Keller et al. | |
| 6,938,799 | B1 * | 9/2005 | Berntsen et al. | 222/137 |
| 2002/0145007 | A1 * | 10/2002 | Sawhney et al. | 222/137 |

FOREIGN PATENT DOCUMENTS

EP 0 791 403 B1 12/1999

(Continued)

*Primary Examiner* — Frederick C. Nicolas
(74) *Attorney, Agent, or Firm* — Foley & Lardner LLP

(57) ABSTRACT

Disclosed is a dispensing device comprises a dispense mechanism and a multicomponent syringe. The fastening parts of the syringe are embodied such that the syringe can be inserted into a holder on the dispense mechanism on the plane of the reservoirs thereof and perpendicular to the plane formed by the handle and the triggering lever of the dispense mechanism. The fastening parts on the syringe and the insertion opening on the syringe holder of the dispense mechanism are provided with coding elements that ensure that the syringe is inserted in only one direction, thus preventing non-certified syringes from being dispensed by the dispense mechanism. In a preferred embodiment, ergonomically shaped syringe flanges can optionally be used for dispensing the syringe in an optimal manner by hand with the aid of a dispense mechanism.

9 Claims, 2 Drawing Sheets

FOREIGN PATENT DOCUMENTS

| | | |
|---|---|---|
| JP | 63-310667 | 12/1988 |
| JP | 10-001198 | 1/1998 |
| JP | 3050304 | 7/1998 |
| WO | WO 95/22941 | 8/1995 |

* cited by examiner

DISPENSING DEVICE COMPRISING A DISPENSING APPLIANCE AND A MULTICOMPONENT SYRINGE

CROSS-REFERENCE TO RELATED APPLICATIONS

This application is the National Phase of PCT/CH2005/000422, filed Jul. 19, 2005, and published as WO 2006/015506, which in turn claims priority to Switzerland Application No. 1321/04, filed Aug. 9, 2004, the contents of these applications are incorporated herein by reference.

FIELD OF THE INVENTION

The present invention relates to a dispensing device comprising a dispensing appliance and a multicomponent syringe or cartridge, the fastening parts of the syringe or cartridge being configured such that the syringe or cartridge is insertable into a holder on the dispensing appliance in the plane of its storage containers and transversally to the plane formed by the handle and trigger of the dispensing appliance.

BACKGROUND OF THE INVENTION

Such a dispensing device comprising a multicomponent cartridge is e.g. known from U.S. Pat. No. 5,005,735 to the applicant of the present invention. This American patent specification discloses both a lateral insertion and an insertion from the top while in the case of a lateral insertion only a cross-sectional ratio of 1:1 is shown and no coding means are disclosed so that the cartridge is insertable in two positions.

In FIG. 4 of that same patent specification, an embodiment is disclosed where the cartridge is inserted from the top while the storage container having the smaller cross-section is inserted first and it is apparent that the storage container having the larger diameter is not firmly retained. In the embodiment according to U.S. Pat. No. 5,336,014 to the applicant of the present invention, the cartridge is inserted from the top and the storage cylinders are side by side during their insertion.

In critical applications, especially in medical technique, it is indispensable to make use of safe systems that prevent a confusion of syringes or the use of arbitrary syringes on a dispensing appliance in order to be sure that only the correct syringes with the correct content are used.

Furthermore it is important that the syringes, which comprise different storage containers, are inserted in the correct position with regard to these containers since the dispensing appliance might otherwise be damaged, thereby making the dispensing operation impossible. This may result in a delayed application that may be dangerous for the patient.

SUMMARY OF THE INVENTION

On this background, it is the object of the present invention to provide a dispensing device that ensures a high operating safety and in which only syringes or cartridges can be used which are intended for this purpose and are insertable in the appliance in a defined position. This object is attained with a device wherein the fastening means on the syringe or cartridge and the holder on the dispensing appliance are provided with coding elements that allow an insertion of the syringe or cartridge in only one orientation.

A second object of the invention is to attach the syringe or cartridge to the dispensing appliance in such a manner that the storage container having the largest cross-section and thus the highest dispensing resistance is most firmly retained. This object is attained by the device wherein the coding is configured such that the syringe or cartridge has to be inserted with the storage container having the larger cross-section first.

Another object of the invention is to provide such a design of the syringe that it has an ergonomically optimal shape for direct manual dispensing, and furthermore to allow syringes or cartridges of a large range of dimensions to be dispensed. These objects are attained according to the dependent claims.

BRIEF DESCRIPTION OF THE DRAWINGS

The invention will be explained in more detail hereinafter with reference to drawings of an exemplary embodiment.

DETAILED DESCRIPTION OF THE INVENTION

Figure 1:
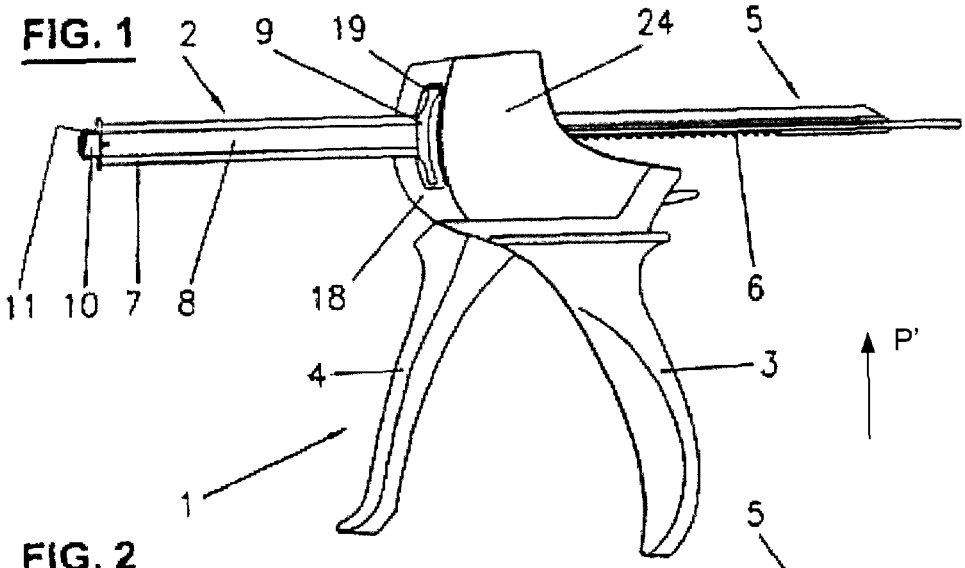
FIG. 1 shows the device of the invention in a perspective side view.
Figure 2:
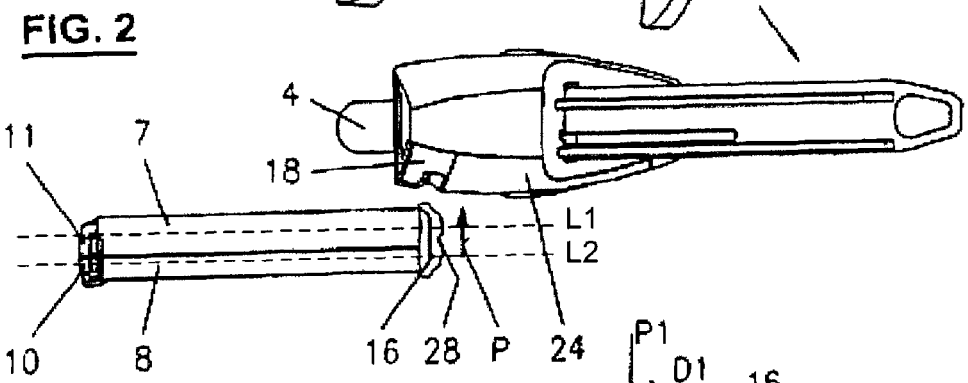
FIG. 2 shows the device of FIG. 1 seen from above and separated.
Figure 5:
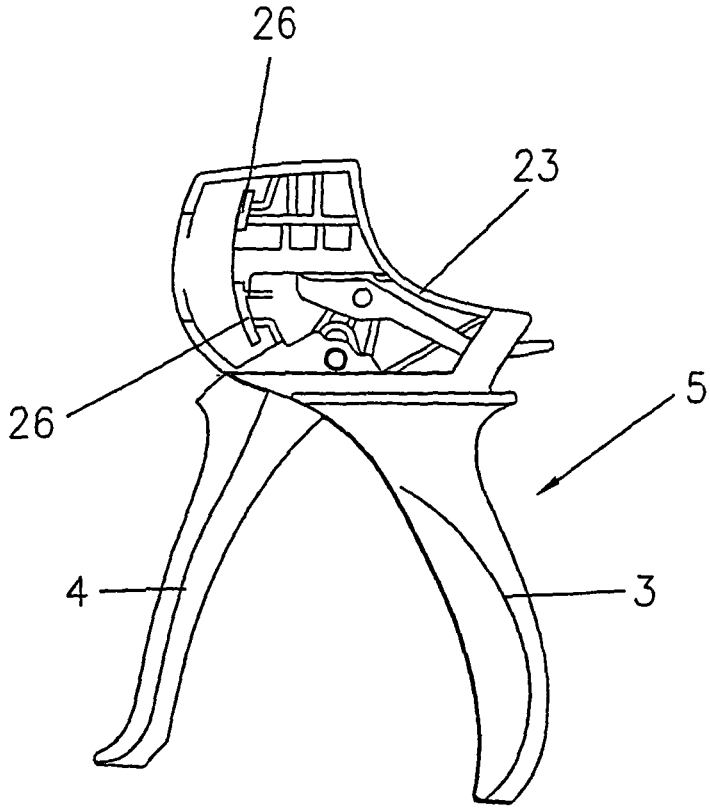
FIG. 5 shows the dispensing appliance of FIG. 1 with the sidewall and the syringe holder removed.

FIG. 1 illustrates a dispensing device according to the invention which includes a dispensing appliance 1 and a multicomponent syringe 2, here a double syringe, hereinafter called syringe for the sake of simplicity, the syringe being inserted laterally with respect to the plane defined by a handle 3 and trigger 4 of the dispensing appliance. The insertion plane of the syringe is symbolically indicated by arrow P in FIG. 2. The insertion plane P is perpendicular to the plane P' formed by the handle and the trigger, as shown in FIG. 1. FIG. 1 further illustrates double plunger 5 with toothing 6 in which a feed system engages that will be explained with reference to FIG. 5.

In the present case, syringe 2 comprises two storage containers 7 and 8, storage container 7 having a larger cross-section than storage container 8 and accordingly a larger volume. On its inlet side, the syringe has a retaining or fastening flange 9 and on its outlet side the two outlets 10 and 11 as well as fastening means 12, e.g. bayonet sockets.

Figure 3:
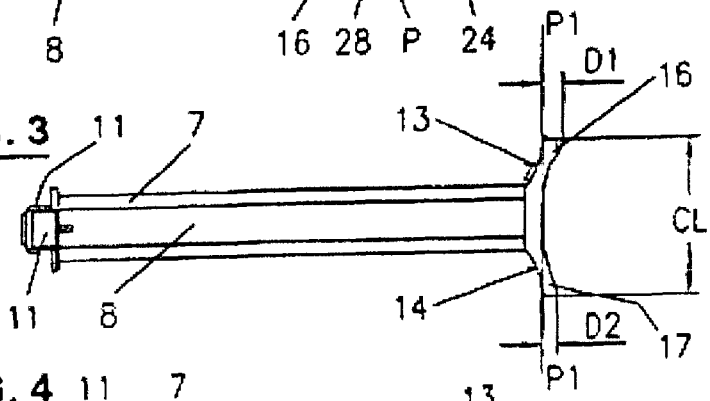
FIG. 3 shows the multicomponent syringe of the device of FIG. 1 from above.

Fastening flange 9 has two legs 16 and 17 serving as finger rests in the event that the syringe is actuated by hand, support surfaces 13 and 14 on the legs, which are directed toward the syringe outlet, being anatomically shaped, i.e. curved. The result is an angled shape of fastening flange 9 as it is best visible in FIG. 3. In other words, this means that the fastening flange, rather than extending perpendicularly to the plane formed by the longitudinal axis L1, L2 of the storage cylinders, has two legs that are angled with respect to this insertion plane P1 or P, the support surfaces of the legs suitably forming an angle of 20°-35° with respect to insertion plane P1.

This angled shape of the fastening flange constitutes one of the coding means whereby other syringes or cartridges found on the market cannot be used and therefore the risk is eliminated that uncertified syringes might be used with this dispensing appliance. As further follows from FIG. 3, the thickness D1 of leg 16 of the fastening flange is greater than the thickness D2 of leg 17 of the fastening flange.

Figure 6:
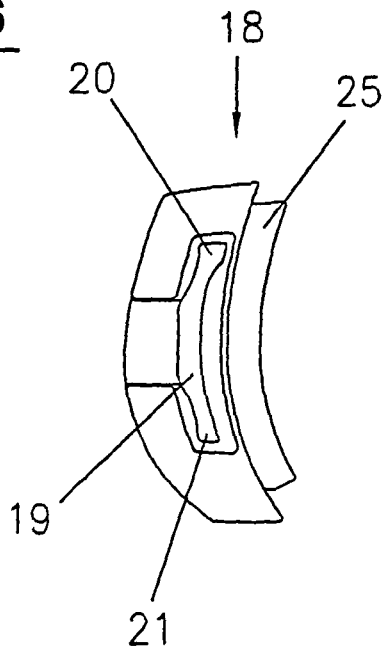
FIG. 6 shows a syringe holder in a side view.

As follows from FIGS. 6 and 7, syringe holder 18 is in the form of a separate exchangeable part, the syringe holder having an insertion opening 19 that is shaped in accordance with fastening flange 9. Thus, insertion opening 19 has a slot 20 that corresponds to the upper, thicker leg 16 of the fastening flange and a second slot 21 that corresponds to the lower, thinner leg 17 of the fastening flange.

Syringe holder 18 with its U-shaped guiding portion 22 is inserted in a correspondingly shaped opening in housing 23 and retained by cover 24, see FIG. 1, the forepart of the cover extending over a side 25 of a U-shaped shoulder whose other two sides are fastened to retaining wall 26 of the appliance. On the appliance side of the syringe holder, the wall of the latter has a passage 27 for the plungers as well as a cutout for the thrust plates.

Figure 4:
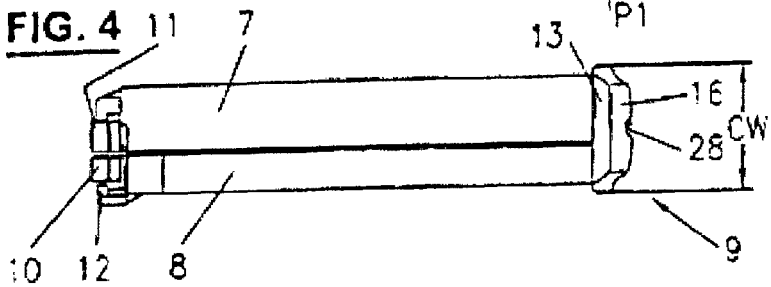
FIG. 4 shows the syringe of FIG. 3 in a side view.
Figure 4A:
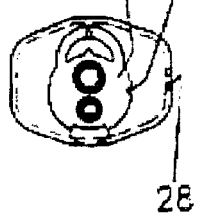
FIG. 4A shows a front view of the syringe of FIG. 4.

In FIG. 4, a notch 28 is shown on the thicker leg 16 of the fastening flange which serves as a mark respectively as a visual coding means. In the context of the present dispensing device, the notch is always provided on the thicker leg of the fastening flange, the notch corresponding to another visual coding means, here a notch 30, on cartridge outlet flange 31 respectively on the mixer coupling—see FIG. 4A, thereby allowing a directional attachment both of the syringe and of the mixer and thus a very high operating safety. Notches 28 and 30 are also provided on syringes whose storage containers have a cross-sectional ratio of 1:1.

Figure 7:
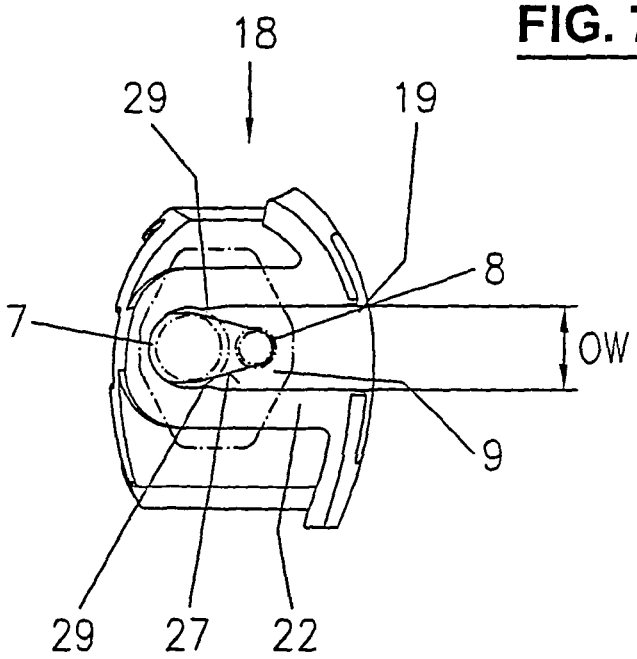
FIG. 7 shows the syringe holder in a top view.

In FIG. 7 it is illustrated that the contour of insertion opening 19 is not continuous but has a constriction, e.g. a small nose 29 on both sides that has to be overcome by the storage container which is inserted first, whereby the syringe is retained. It is further apparent in FIG. 7 that in the case of syringes having different storage containers, the syringe is always inserted with the largest storage container first so that its flange part is held on a large circumference while the smaller storage cylinder is held over a sufficient portion of the fastening flange. In this manner, the highest forces produced on the side of the larger storage cylinder are absorbed.

In the 1:1 version, as compared to the 4:1 or 10:1 versions, only medium-sized forces are produced at the storage containers which are sufficiently absorbed by the fastening flange.

On this basis, for each syringe type and size, a syringe holder having a corresponding insertion opening is manufactured whose exterior contour is however always the same in order to be fastened in the opening of the dispensing appliance. It is also possible to design the syringe holders such that they can be exchanged without having to remove the cover on the appliance housing beforehand. In this context it shall be mentioned that in order to remove the syringe holder, the double plunger has first to be completely withdrawn from the appliance.

In a set of syringes and/or syringe holders, a coding of the syringe sizes, respectively of their volumes and/or the ratio of the storage containers, i.e. the mixing ratio is very advantageous. Thus, the length CL and the width CW of the fastening flange, see FIGS. 3 and 4, can be used for coding the syringe volumes, and the opening width OW of the U-shaped guiding portion of the syringe holder can be used for coding the mixing ratio. A subsidiary color coding may be provided independently thereof.

The feed mechanism of the dispensing appliance is known per se, e.g. from U.S. Pat. No. 5,992,694 to the applicant of the present invention. Important in such an appliance is an efficient transformation of the force and movement of a lever into a linear forward motion of the plungers.

The device has been described with reference to a double syringe, but instead of a double syringe, also a syringe having more than two storage cylinders may be provided while if a dispensing appliance is used, the latter generally has the same number of plungers. Moreover, as already mentioned in the introduction, cartridges may be provided instead of syringes. The outlet of the syringe or cartridge may be intended for a conventional mixer of the prior art and may receive a closing cap that is known per se, or other mixing and dispensing systems as well as extension parts or tubes may be connected.

The invention claimed is:

1. A dispensing device comprising:

a dispensing appliance including a handle and a trigger;

a holder disposed on the dispensing appliance; and a multicomponent syringe or cartridge including storage containers and a fastening flange with a first leg and a second leg, the fastening flange configured to be inserted into an insertion opening of the holder;

wherein the insertion opening of the holder is positioned in a plane formed by the handle and trigger, wherein the syringe or cartridge is inserted into the insertion opening of the holder in an insertion plane perpendicular to the plane formed by the handle and the trigger, wherein the fastening flange and the holder are provided with complementary coding elements that allow an insertion of the syringe or cartridge in only one orientation, prevent an undesired syringe or cartridge from being used, allow only particular syringe sizes to be used, and/or allow particular mixing ratios to be used, the coding elements including at least one of:

an angle of the first leg and the second leg of the fastening flange with respect to a plane in which the syringe or cartridge is inserted into a complementary insertion opening of the dispensing appliance, a length of the first leg and a length of the second leg of the fastening flange and the complementary insertion opening, a width of the fastening flange and the complementary insertion opening, a thickness of the first leg is greater than a thickness of the second leg and the complementary insertion opening; and a width of the holder and the complementary insertion opening, and wherein the insertion opening includes a constriction.

2. The dispensing device according to claim 1, wherein if the coding element includes the angle, the angle ranges from 20° to 35° and wherein the first leg and the second leg have an ergonomic curvature.

3. The dispensing device according to claim 1, wherein the storage containers have a cross-sectional ratio that is different from 1:1, and wherein the coding is configured such that the storage container having the largest cross-section is the first storage container inserted into the syringe or cartridge.

4. The dispensing device according to claim 1, wherein one of the first leg and the second leg includes a first visual coding that mates to a second visual coding on an outlet of the syringe or cartridge.

5. The dispensing device according to claim 1, wherein the holder is a separate component from a housing, and wherein the holder is removably coupled to the housing included in the dispensing appliance.

6. The dispensing device according to claim 1, further comprising:

a plurality of second syringes or cartridges each including second storage containers having different geometrical dimensions and different cross-sectional ratios; and a set of exchangeable second holders including second insertion openings adapted to receive second fastening flanges with second angled legs of each second syringe or cartridge, wherein each second holder includes a guiding portion and a side configured to insert into a second housing, and wherein the second housing is included in the dispensing appliance.

7. The dispensing device according to claim 6, wherein coding elements of each syringe volume are length and/or width of each fastening flange, and wherein coding elements of a mixing ratio of the storage containers is a width of the guiding portion.

8. The dispensing device according to claim 1, wherein if the coding element includes the angle, each of the first leg and the second leg include a surface directed toward a syringe outlet.

9. The dispensing device according to claim 1, wherein one of the first leg and the second leg includes a first visual coding that mates to a second visual coding on an outlet of the syringe or cartridge.

* * * * *